US005219242A

United States Patent [19]

Liaw

[11] Patent Number: 5,219,242

[45] Date of Patent: Jun. 15, 1993

[54] PLUG CONNECTOR

[76] Inventor: Shuenn-Liang Liaw, No. 3, Lane 4, Ruey Song Street, Hsichih Chen, Taipei Hsien, Taiwan

[21] Appl. No.: 950,660

[22] Filed: Sep. 23, 1992

[51] Int. Cl.[5] ..... H01K 13/59

[52] U.S. Cl. ..... 403/380; 403/375; 403/344; 403/289; 403/24; 439/466; 439/467

[58] Field of Search ..... 439/465, 466, 467, 468, 439/469; 403/380, 375, 344, 289, 24; 220/327, 253, 259, 244

[56] References Cited

FOREIGN PATENT DOCUMENTS 2133638 7/1984 United Kingdom ..... 439/465

2203002 10/1988 United Kingdom ..... 439/465

*Primary Examiner*—Randolph A. Reese

*Assistant Examiner*—Christopher J. Novosad

*Attorney, Agent, or Firm*—Morton J. Rosenberg; David I. Klein

[57] ABSTRACT

A plug connector for use in a computer system comprised of an upper shell side-hinged to a lower shell by a connecting portion. The upper shell has pins respectively inserted into pin holes on the lower shell, a pair of opposite eye end posts side-matched to a pair of opposite eye end posts on the lower shell respectively and retained together by respective screw bolts, a pair of opposite semi-circularly notched upright blocks end-matched to a pair of opposite semi-circularly notched upright blocks on the lower shell in providing two round holes respectively aligned with the eye end posts for inserting and supporting the screw bolts.

1 Claim, 2 Drawing Sheets

PLUG CONNECTOR

BACKGROUND OF THE INVENTION

The present invention relates to plug connectors for use in computer systems.

Various plug connectors are known and used in computer systems for different purposes. Regular plug connectors are generally comprised of two opposite shells connected together by screws and hooks. These plug connectors are easy to assemble but difficult to dismantle. Because of the complicated structure, the manufacturing cost of these plug connectors is quite expensive.

SUMMARY OF THE INVENTION

The present invention has been accomplished under the aforesaid circumstances. It is therefore an object of the present invention to provide a plug connector which is easy to assemble to dismantle. It is another object of the present invention to provide a plug connector which is inexpensive to manufacture.

According to the preferred embodiment, the plug connector is comprised of an upper shell side-hinged to a lower shell by a connecting portion. The upper shell has pins respectively inserted into pin holes on the lower shell as the upper and lower shells are closed together. The upper and lower shells each has a pair of opposite eye end posts side-matched to each other, and a pair notched upright blocks end-matched to each other. A screw bolt each is respectively inserted through a respective countersunk hole formed on the border of the upper and lower shells, the round hole formed between the end-matched upright blocks on the same side and the round holes on the side-matched posts on the same side and threaded into a terminal assembly to retain the upper and lower shells together.

DETAILED DESCRIPTION OF THE PREFERRED EMBODIMENT

Figure 1:
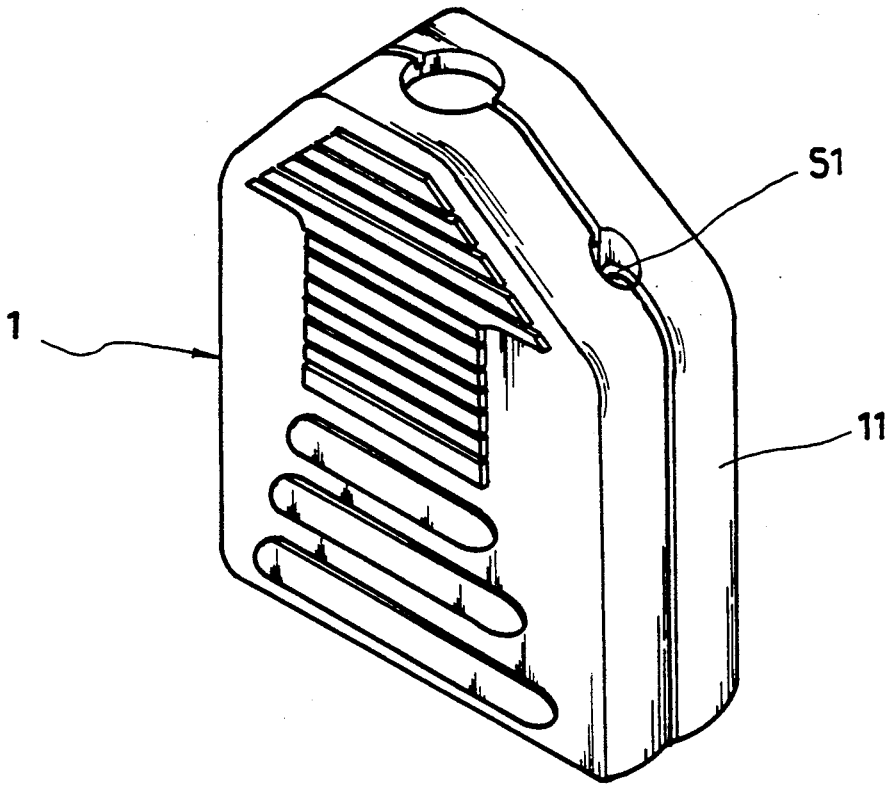
FIG. 1 is an elevational view showing the outer appearance of a plug connector as constructed in accordance with the present invention.
Figure 2:
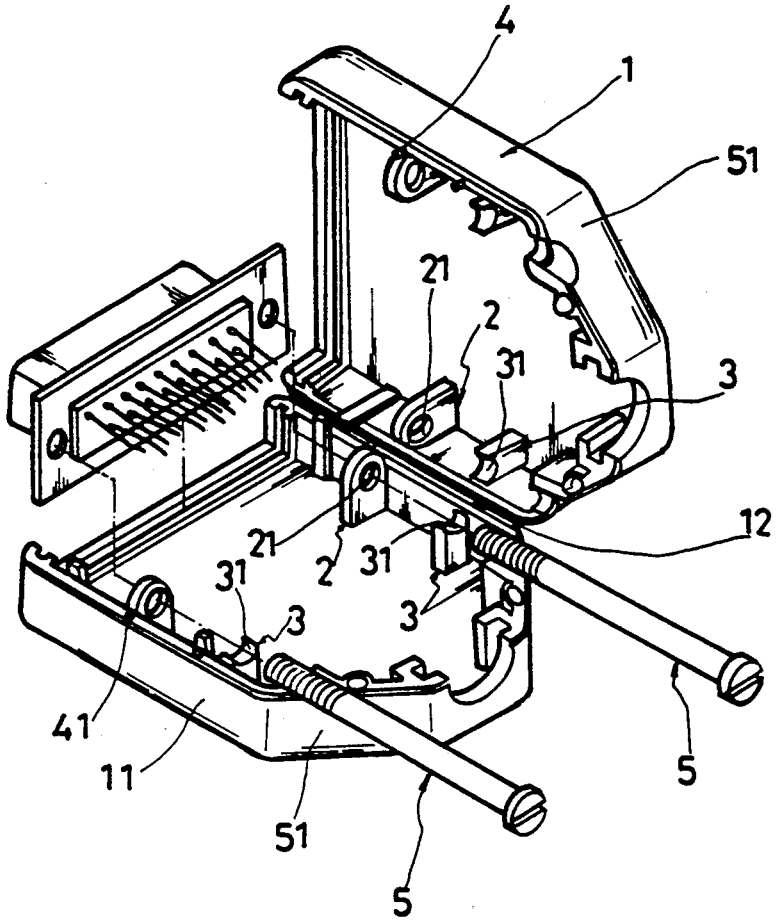
FIG. 2 is an exploded view thereof.
Figure 3:
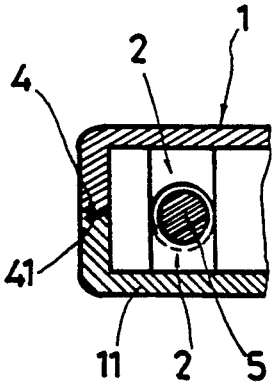
FIG. 3 is a partly sectional view thereof showing one pin on the upper shell inserted in a respective pin hole on the lower shell, one post on the upper shell side-matched to a respective post on the lower shell and retained together by a screw bolt.
Figure 4:
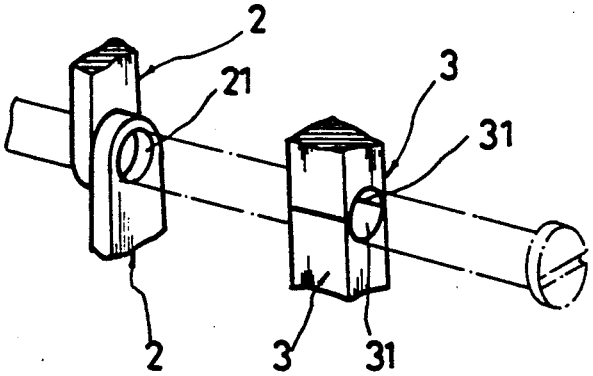
FIG. 4 shows a screw bolt inserted through a round hole formed between two end-matched upright blocks and round holes on two side-matched posts.

Referring to the annexed drawings in detail, a plug connector as constructed in accordance with the present invention is generally comprised of an upper shell 1 laterally hinged to a lower shell 11 by a connecting portion 12. Therefore, the upper shell 1 can be opened then closed relative to the lower shell 11. The upper and lower shells 1, 11 each has one pair of opposite posts 2 and one pair of opposite upright blocks 3 bilaterally disposed on the inside, wherein the upright blocks 3 are respectively spaced behind the posts 2; the posts 2 on the upper shell 1 are disposed at offset locations relative to the posts on the lower shell 11, each post has a round hole 21 adjacent to the respective top end; each upright block 3 has a semicircular notch 31 on the respective topmost edge. The upper shell 1 further comprises a plurality of pins 4 projecting from a peripheral edge thereof at locations corresponding to a plurality of pin holes 41 on the lower shell 11. As the upper and lower shells 1, 11 are closed together, the pins 4 on the upper shell 1 are respectively fitted into the pin holes 41 on the lower shell 11, the round hole 21 on each post 2 on the the upper shell 1 is respectively aligned with the round hole on the respective post 2 on the lower shell 11, and the semi-circular notch 31 on each upright block 3 on the upper shell 1 is respectively incorporated with the semi-circular notch 31 on the respective upright block 3 on the lower shell 1 is respectively incorporated with the hole in line with the round hole 21 on the posts 2 on the same side. As the upper and lower shells 1, 11 are closed together, two spaced countersunk holes 51 are formed on the top thereof respectively aligned with the round hole of the respective semi-circular notches 31 of the upright blocks 3 and the round holes 21 of the respective posts 2 on the same side, through which two screw bolts 5 are respectively inserted to retain the upper and lower shells 1, 11 together.

What is claimed is:

1. A plug connector comprised of an upper shell side-hinged to a lower shell by a connecting portion to hold a terminal assembly, wherein said upper shell has a plurality of pins upstanding from a peripheral edge thereof respectively inserted into respective pin holes on a peripheral edge on said lower shell, a pair of eye end posts side-matched to a pair of eye end posts on said lower shell, a pair of notched upright blocks end-matched to a pair of notched upright blocks one said lower shell with a round hole formed between on notched upright block on said upper shell and the corresponding notched upright block on said lower shell and aligned with the hole of the eye end on said upper shell and the hole on the eye end on said lower shell on the same side for inserting a respective screw bolt in retaining said upper and lower shells together.

* * * * *